US006723413B2

(12) United States Patent
Walters

(10) Patent No.: US 6,723,413 B2
(45) Date of Patent: Apr. 20, 2004

(54) TUFTED SURFACE COVERING AND METHOD

(76) Inventor: Ian D. Walters, 117 Pen Y Garn Road, Ammanford, Wales (GB), SA183PF ( * ) Notice: Subject to any disclaimer, the term of this patent is extended or adjusted under 35 U.S.C. 154(b) by 219 days.

(21) Appl. No.: 09/681,865

(22) Filed: Jun. 19, 2001

(65) Prior Publication Data

US 2003/0044549 A1 Mar. 6, 2003

(51) Int. Cl.[7] ..... D05C 17/02; B32B 3/00

(52) U.S. Cl. ..... 428/95; 428/87; 428/96; 156/72; 264/109

(58) Field of Search ..... 428/95, 96, 97, 428/87, 15, 17; 26/2 R; 156/72; 264/112, 113, 123, 125, 126, 128, 109

(56) References Cited

U.S. PATENT DOCUMENTS

| | | | |
|---|---|---|---|
| 3,565,710 | A | 2/1971 | Garvin |
| 3,821,066 | A | 6/1974 | Tillotson et al. |
| 3,904,799 | A | 9/1975 | Shorrock |
| 3,935,352 | A | 1/1976 | Toland |
| 3,944,452 | A | 3/1976 | Toland et al. |
| 4,016,316 | A | 4/1977 | Bohrn |
| 4,035,533 | A | 7/1977 | Chambley |
| 4,112,161 | A | 9/1978 | Sorrells |
| 4,605,580 | A | 8/1986 | Goolsby et al. |
| 5,445,860 | A | 8/1995 | Bova |
| 5,532,035 | A | 7/1996 | Corbin et al. |
| 5,604,009 | A | 2/1997 | Long et al. |
| 5,630,896 | A | 5/1997 | Corbin et al. |
| 5,660,911 | A | 8/1997 | Tesch |
| 5,800,898 | A | 9/1998 | Gerry |
| 5,837,769 | A | 11/1998 | Graafland et al. |
| 5,902,662 | A | 5/1999 | Kerr |
| 5,968,631 | A | 10/1999 | Kerr |

*Primary Examiner*—Cheryl A. Juska
(74) *Attorney, Agent, or Firm*—Marcia J. Rodger, Esq.; Shughart, Thomson & Kilroy, P.C.

(57) ABSTRACT

The tufted surface covering includes a base formed from particles of a thermosetting polymer compound mixed with a particle binding agent causing a portion of the particles to bind together to form a self supporting web. The base is tufted with a tufting material. Thermosetting vulcanized natural and/or synthetic rubber compounds are employed. The polymer layer is tufted with a tufting material and heated to a temperature of from about 110° C. to about 220° C. at an elevated pressure of up to two tons per square inch, to cause the particles to bind together at elevated temperature and pressure to anchor and seal the tufts in place. Cross-linking agents and polar polymer containing compounds may be employed as particle binding agents. In another aspect of the invention, a second layer of particles of a thermosetting polymer mixed with a particle binding agent may be joined together with the particles of the first layer at elevated temperature and pressure. A series of spaced apertures extends through the first and second layers to enable free draining of the surface covering. The lower surface of the covering includes spaced indentations to reduce the weight of the covering.

29 Claims, 2 Drawing Sheets

TUFTED SURFACE COVERING AND METHOD

BACKGROUND OF INVENTION

The present invention relates to an improved tufted surface covering and method.

Tufted surface coverings are employed indoors as floor coverings in the form of carpeting, area rugs, floor, gym, barrier and crash mats, as well as outdoors, in the form of carpeting, artificial turf, cushioned sport and play surfaces and sport mats. Surface coverings for sporting use are generally constructed by stitching into a preformed fabric backing layer to form tufts, and then bonding the primary backing layer to an impact-absorbing resilient lower layer or shock pad, by means of a thin, laminating layer.

Conventional tufting machines employ rows of needles, which are threaded with a suitable yarn fed from a ball or creel through an aperture adjacent the tip of each needle. The tufting machine forces the rows of needles through a backing fabric. The needles pierce the fabric from back to front, pushing the yarn through the backing. Looping tools catch the yarn loops on the face of the backing as the needles are withdrawn. Once tufting of the primary backing is completed, the loops of face yarn are generally cut to form a pile surface or "face". While the loops may be left uncut for indoor carpet surfaces, the loops of surfaces intended for outdoor usage are generally cut in order to produce a covering more closely resembling grass. The diameter of the yarn, the number of yarn strands in each tuft, and the spacing of the tufts determine the density of the final surface.

A woven or nonwoven fabric web is generally employed as a tufting base or primary backing layer. A laminating layer of glue, rubber or synthetic resin must be applied over the exposed loops to lock the tufts into the fabric interstices or punctured holes and to bond the backing layer to a shock absorbing layer. Alternatively, a secondary layer may be laminated to the primary layer. The tufted loops on the underside of the primary layer may also be melted to form a button, which secures the loops, but does not seal them. Such sealing is necessary in order to retain the tufts in place to withstand the stresses associated with usage as well as to seal in surface coverings intended for outdoor use against the entry of water. Entry of moisture into the needle holes surrounding the tufts, followed by repeated freeze-thaw cycles, would eventually damage the covering.

The use of fabric webs, elastomeric tufting layers and laminating layers all serve to spread the force of any impact to the surface covering. This dissipation of force affects the traction and torque characteristics of the covering. For this reason, although known synthetic turf surfaces may be constructed to visually resemble natural grass turf, they are not functionally equivalent. The characteristics of play associated with a sport differ on synthetic turf from the play on natural turf. For example, the cleats on athletic footwear do not purchase on synthetic surfaces in the same manner as on natural turf. Balls striking synthetic surfaces bounce higher, retain their spin and travel farther than on natural turf.

There are also certain weaknesses of dimensional stability associated with surface coverings constructed by laminating multiple layers. Each layer of the laminate has discrete physical properties which are determined by its composition. For example, each layer expands and contracts at a different rate. Use of hydrophilic or hydroscopic materials may also introduce moisture into one or more lamina of the covering.

In addition, known artificial turf surfaces demonstrate limited ability to withstand the heavy wear and substantial stresses associated with high impact sports over extended periods of time. In sports such as golf, cricket, field hockey, polo and la Crosse, which employ clubs, bats and sticks, force is applied tangentially across the upper layer of a synthetic turf. Because such laminated sport surfaces do not provide significant horizontal movement, these tangential forces can cause the turf to delaminate with wear. In the case of laminated golf mats, lack of horizontal elasticity may actually cause the carpet layer to melt to the club upon striking.

Thus, there is a need for a tufted surface covering which can withstand both the vertical and horizontal forces associated with athletic use, which seals the tufts in place against wear and water damage and which absorbs the forces of play in a manner similar to natural turf.

SUMMARY OF THE INVENTION

The present invention provides a greatly improved surface covering having a tufted impact-absorbing layer. This construction provides tufts which are securely anchored against wear and sealed against weather in a covering having efficient impact absorption without the need for a load-spreading laminating layer. The surface covering of the invention includes a layer of particles of a thermosetting polymer compound mixed with a particle binding agent to form a self supporting web. Thermosetting vulcanized natural and/or synthetic rubber compounds are employed. The polymer layer is tufted with a tufting material and heated to a temperature of from about 100° C. to about 220° C. at an elevated pressure of up to two tons per square inch, the particle binding agent causing the particles to bind together at elevated temperature and pressure to anchor and seal the tufts in place. Cross-linking agents and polar polymer containing compounds may be employed as particle binding agents. In another aspect of the invention, a second layer of particles of a thermosetting polymer mixed with a particle binding agent may be joined with the particles of the first layer at elevated temperature and pressure. A series of spaced apertures extends through the first and second layers to enable free draining of the surface covering. The lower surface of the covering includes spaced indentations to reduce the weight of the covering.

Objects and advantages of this invention will become apparent from the following description taken in relation to the accompanying drawings wherein are set forth, by way of illustration and example, certain embodiments of the invention.

The drawings constitute a part of this specification and include exemplary embodiments of the present invention and illustrate various objects and features thereof.

DETAILED DESCRIPTION

Figure 1:
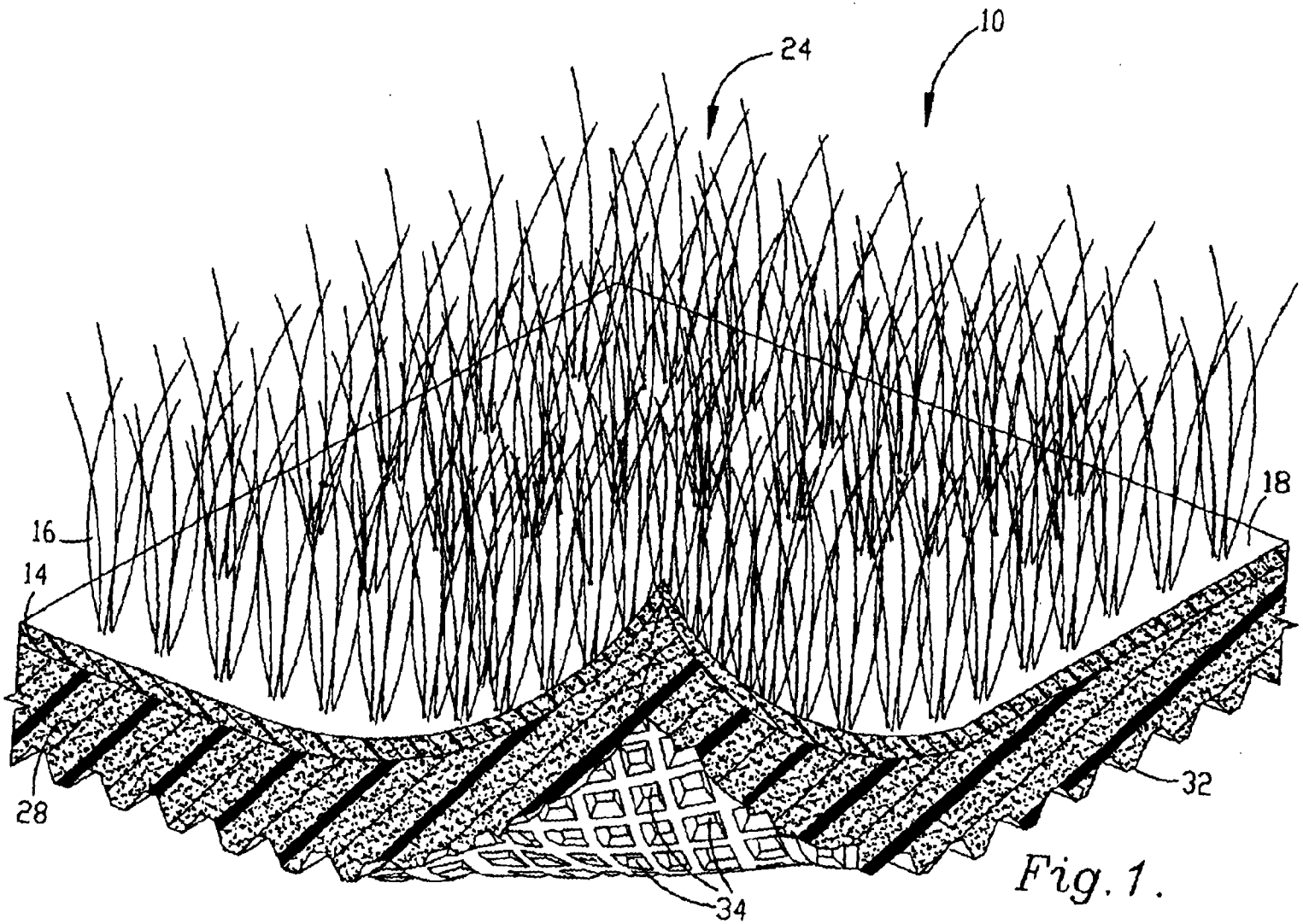
FIG. 1 is a perspective view of a tufted surface covering in accordance with the invention, with a corner lifted to display dimpling on the lower surface of a second layer thereof.
Figure 2:
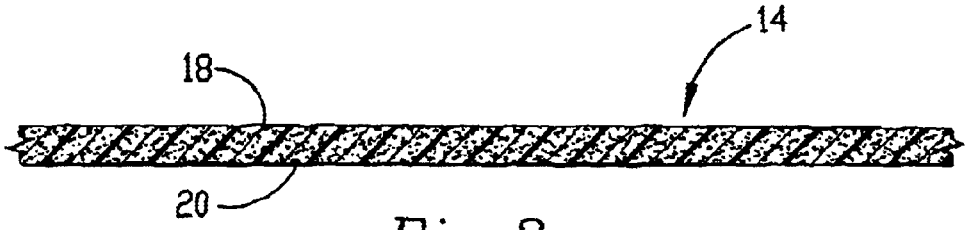
FIG. 2 is a cross sectional view of a first layer of a surface covering.
Figure 3:
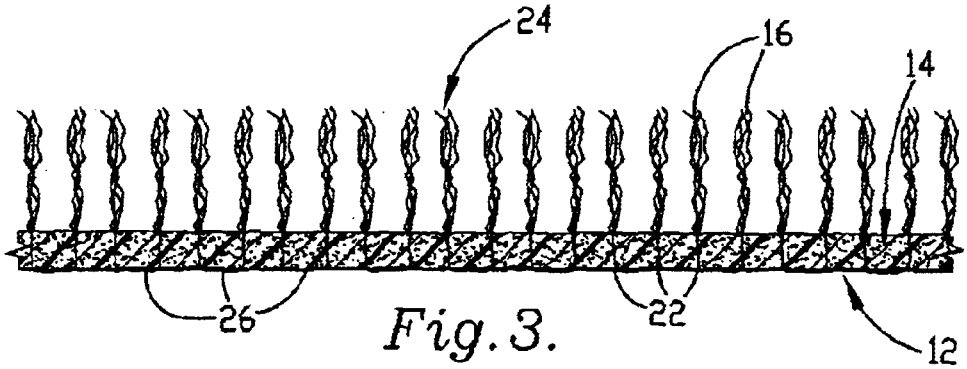
FIG. 3 is a cross sectional view of a tufted layer of the surface covering.
Figure 4:
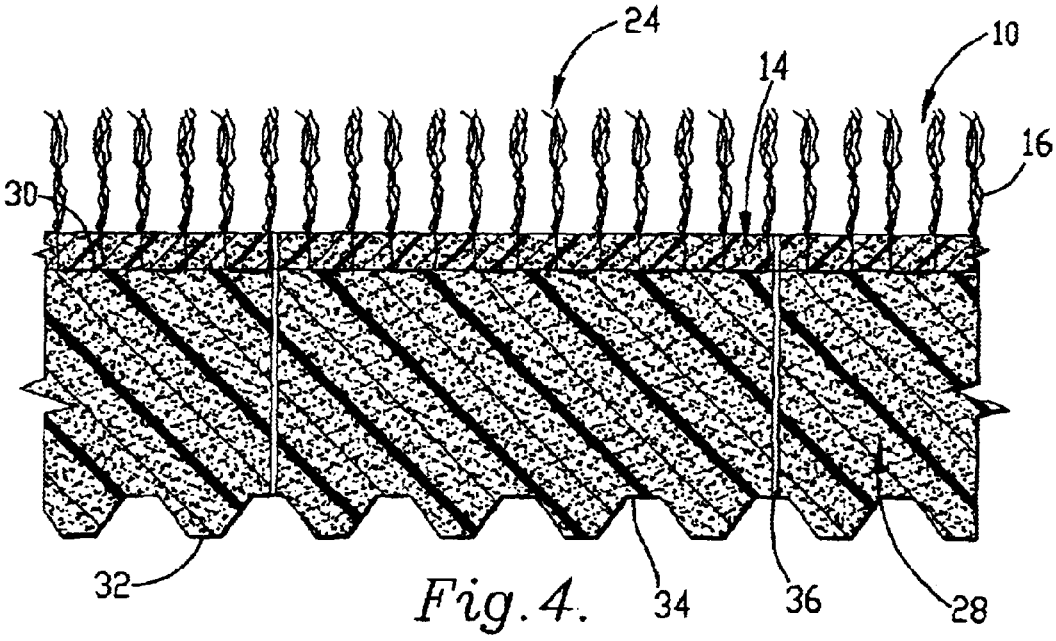
FIG. 4 is a cross sectional view of a two-layered surface covering similar to that depicted in FIG. 1.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring now to the drawings, a tufted surface covering 10 includes a tufted layer 12 having a base 14 and a series of tufts 16. The base 12 includes an upper surface 18 and a lower surface 20. A series of spaced needle holes 22 extend between the surfaces 18 and 20. The tufts 16 extend through the holes 22 to include an upper or face portion 24 covering the upper surface 18 of the base 14 and a lower loop portion 26, extending at spaced intervals over the lower surface 20 of the base 14.

The tufted layer 12 may be employed as a surface covering by itself, or it may be coupled with a resilient second layer 28 having an upper surface 30 and a lower surface 32. The lower surface 32 includes a plurality of spaced indentations 34. A plurality of spaced apertures 36 extend through the base or first layer 14 and the second layer 28 to provide a free-draining surface covering 10.

The base 14 is composed of joined granules or particles of a polymer compound. The polymer compound may have thermosetting characteristics such as a vulcanized natural rubber and/or a synthetic rubber composition. Styrene-butadiene rubber (SBR) and/or nitrile-butadiene rubber (NBR), ethylene propylene difunctional monomer copolymer (EPDM), ethylene-vinyl acetate copolymer (EVA), polyvinyl chloride, polychloroprene (neoprene), polyurethane and mixtures thereof may be employed. The polymer compound may be obtained by recycling, as, for example, so-called reclaimed "crumb rubber", which generally consists primarily of SBR particles. Such polymer particles may also include various additives, such as antioxidants, ultraviolet radiation stabilizers, and catalysts, including stearic acid, zinc oxide, carbon black, calcium carbonate and mixtures thereof. The polymer particles are preferably of randomly mixed sizes of from about 0.005 mm (2500 mesh) to about 3.55 mm (6 mesh), with a particularly preferred particle size of about 500 microns (30 mesh), although so-called "crumb rubber dust" may also be used.

The base 14 is constructed by mixing a quantity of thermosetting polymer particles with a quantity of a particle binding agent. The particle binding agent may include a cross-linking agent, such as sulfur and/or a zinc oxide, dibutyl thiourea, tellurium diethyldithiocarbonate, EPDM, EVA, polypropylene or any other suitable compound or mixture thereof. Alternatively, the particle binding agent may include a polar polymer compound, such as polyurethane, EPDM, EVA, polyamide, polypropylene, latex or any other suitable compound or mixtures thereof. Where a polar polymer compound is employed, mixing causes the crumb rubber particles to be coated to have a size of from about 0.5 mm to about 7 mm. In addition, quantities of a plasticizer, such as diisononyl phthalate, trinonylphenolphosphate, talc, an ultraviolet radiation stabilizer, such as a substituted hydroxyphenyl benzotriazole such as tinuvin, stearic acid, carbon black, calcium carbonate, talc, diisononyl phthalate, zinc oxide and azodicarbonamide. Those skilled in the art will appreciate that any of a number of compositions of the same chemical classes may be employed.

The mixture is extruded, rolled or calendared to form a planar self supporting web or base 14 having a thickness of from about 1 mm to about 30 mm and a density of from about 0.4 to about 1.5 sg. The base 14 is then needle tufted with a tufting material, such as a synthetic polymeric fiber, a natural fiber, or a mixture thereof to form a series of tufts and loops on the upper and lower surfaces 18 and 20. Synthetic polymeric fibers such as polyamides, polyesters and polypropylene are well-suited and may be obtained in the form of extruded filaments or spun yarns. A yarn having a "curl" construction may be employed where it is desirable to produce a covering 10 having a unidirectional surface without stripes. Such polymeric fibers may also include ultraviolet stabilizers and antioxidants. The tufting material may also include any suitable natural fiber such as wool, cotton, jute or ramie, either alone or in combination with one or more synthetic fibers. The hygroscopic characteristics of natural fibers make them particularly well suited for certain types of coverings, such as fireproof barrier mats and static dispersal mats.

Typically, the base 14 is tufted using a conventional tufting machine (not shown). Such machines urge a plurality of needles, which have been threaded with a tufting material, through the base 14 at spaced intervals to form a series of holes 22. Upon withdrawal through the holes, the needles form a series of tufting material tufts 16 on the upper surface 18 of the base 14 and a series of loops 26 on the lower surface 20 of the base 14. In most surface covering applications for sporting use, the tufts 16 subsequently are cut to form a tufted surface or face 24 resembling natural turf. The density and height of the tufts 16 may be varied by adjusting the spacing and pitch of the tufting machine needles.

The base 14 is then cured by subjecting it to a temperature of from about 100° C. to about 220° C. and a force of up to about 2 tons per square inch. Where a cross-linking agent is employed, such elevated temperature and pressure cause the free ends of a portion of the polymer particles to join by cross-linking. Where a polar polymer containing compound is employed, a portion of the polymer particles are joined together by bonding of the polar polymer molecules. The base 14 may be cured in a heated press equipped with a series of platen rollers. The rollers may be provided with a series of spaced pins, so that the cured base 14 will include a series of spaced holes 36 to facilitate a free draining surface. Alternatively, the base 14 may be placed in an oven, such as a gas or infra red oven and pressure may be applied immediately upon removal.

Alternatively, where a polar polymer compound is employed as the binding agent, curing of the base 14 may be accomplished at ambient temperature and pressure. Depending upon the temperature, curing may require a period of from about 12 hours to about 3 days.

In one embodiment, the lower surface 20 of the base 14 is coated with a second layer 28 of polymer particles having a thickness of from about 0.5 mm to about 35 mm and having a density of from about 0.4 sg to about 1.4 SG. The base or first layer 14 and second layer 28 are then subjected to elevated temperature and pressure of from about 100° C. to about 220° C. and up to about 2 tons per square inch to join a portion of the polymer particles in the second layer 28 with a portion of the polymer particles in the first layer 14.

In another embodiment, the second layer 28 is formed of a mixture of polymer particles and a binding agent and subjected to elevated temperature and pressure as previously described. It is foreseen that in either embodiment, additives may be incorporated as previously described and the temperature may be elevated by application of heat from a heat source directed toward the lower surface 32 of the second layer 28. At the same time, cooling means may be employed to cool the tufted face 24 to protect the tufts 16 of the reverse side of the covering 10. Those skilled in the art will appreciate that any number of additional layers may be joined in the same manner as previously described.

The polymer granules of the second layer 28 may be of larger size than the granules of the first layer 14 in order to reduce the weight of the surface covering and dissipate the energy of impact over a greater area. The weight of the second layer 28 may also be reduced by addition of a chemical blowing agent to the polymer compound particle mixture. The lowermost layer 32 of the second layer 28 may be waffled or dimpled with a plurality of spaced indentations 34, which also serve to reduce the overall weight of the covering 10. The number, size, and arrangement of the indentations 34 may be preselected in order to vary the dynamics and impact absorbing characteristics of the covering 10 in accordance with its intended use. Depending on the extent of any waffling and the amount of blowing agent used, the finished surface covering 10 may have a weight of from between about 850 grams to about 50 kilograms per square meter.

Advantageously, the tufted first and second layers 14 and 28 are chemically as well as physically joined together to form an integrated shock pad capable of multidirectional movement, similar to natural turf. In addition, the tufts 16 are sealed to impart freeze-thaw resistance as well as resistance to growth of bacteria, algae, fungi and seeds.

The covering 10 may be constructed in broadloom or modular form in any suitable size or geometric shape. For use as a sport mat, such as a golf mat, a relatively compact, modular size may be preferred. In such instances, the mat may include a flat border or alternatively, a bound or finished edge.

In use, the finished surface covering 10 of the invention is suitable for use as carpeting or as a sport or athletic surface. Broadloom coverings 10 may seamed together to cover a large surface for use as carpeting, leisure flooring for schools, gyms, nursing homes and for sporting uses such as artificial turf for track, tennis, field hockey, soccer, skiing and snowboarding. The coverings 10 may also be employed as climbing wall crash mats, barrier mats, ice and roller rink surrounds, track, tennis, field hockey, soccer and ski and snowboarding slopes.

EXAMPLE 1

A golf practice mat having a tufted first layer and a second layer is prepared as follows:

A First Batch Mix is prepared by mixing:

9.0 parts by weight mixed recycled particles of NBR, SBR and EPDM 1.0 part by weight mixed PVC and EPDM 0.5 parts by weight diisononyl phthalate 0.2 parts by weight trinonylphenolphosphate 0.175 parts by weight talc 0.12 parts by weight tinuvin A slurry is prepared by mixing:

10.0 parts by weight First Batch Mix 0.125 parts by weight sulfur 0.1 part by weight stearic acid 4.0 parts by weight carbon 0.05 parts by weight diisononyl phthalate 0.5 parts by weight zinc oxide 2.5 parts by weight azodicarbonamide The slurry is poured into a 20 mm deep form and passed through a press at 160° C. and 1.5 tons per square inch pressure to form a first layer.

The cured first layer is needle tufted on a tufting machine with a polyamide yarn fiber manufactured by Dupont under the trademark Antron®.

The tufted mat is placed face down in a roller press heated to 160° C. and covered with a 20 mm layer of the same slurry. The press is lowered to exert 1.5 tons pressure per square inch to bond a portion of the particles of the second layer to a portion of the particles of the first layer.

The finished mat has a uniform thickness of about 18 mm and a weight of from about 0.2 kg per mm thickness per square meter to about 1.3 kg per mm thickness per square meter.

It is understood that, while certain forms of the present invention have been illustrated and described herein, the invention is not to be limited to the specific forms or arrangements of parts described and shown.

What is claimed and desired to be secured by letters patent is as follows:

1. A tufted surface covering, comprising:

a base formed from particles of a polymer compound mixed with a quantity of a particle binding agent, said particle binding agent causing a portion of said particles to bind together;

said base having an upper surface and a lower surface; and said base being tufted through with a tufting material to form a plurality of spaced apart tufting material tufts on said base upper surface and a plurality of spaced apart tufting material loops on said base lower surface.

2. The tufted surface covering of claim 1, wherein:

said polymer compound has thermosetting characteristics; and following tufting, said particles are joined together at a temperature of from about 100° C. to about 220° C. and a pressure of up to about 2 tons per square inch.

3. The tufted surface covering of claim 2, wherein:

said thermosetting polymer compound Is selected from the group consisting of: a vulcanized natural rubber, a synthetic rubber and mixtures thereof.

4. The tufted surface covering of claim 3, wherein:

said thermosetting polymer compound is selected from the group consisting of: nitrile-butadiene rubber, styrene-butadiene rubber, ethylene propylene difunctional monomer copolymer, ethylene-vinyl acetate copolymer, polyvinyl chloride, polychloroprene, polyurethane and mixtures thereof.

5. The tufted surface covering of claim 2, wherein:

said particle binding agent comprises a cross-linking agent.

6. The tufted surface covering of claim 5, wherein:

said cross-linking agent is selected from the group consisting of: sulphur, zinc oxide, dibutyl thiourea, tellurium diethyldithiocarbonate, ethylene propylene difunctional monomer copolymer, ethylene-vinyl acetate copolymer, polypropylene and mixtures thereof.

7. The tufted surface covering of claim 2, wherein:

said particle binding agent comprises a polar polymer containing compound.

8. The tufted surface covering of claim 7, wherein:

said polar polymer containing compound is selected from the group consisting of: a polyurethane, ethylene propylene difunctional monomer copolymer, ethylene-vinyl acetate copolymer, a polyamide, polypropylene, latex and mixtures thereof.

9. The tufted surface covering of claim 2, wherein:

said base further includes a compound selected from the group consisting of a plasticizer, stearic acid, an ultraviolet radiation stabilizer, zinc oxide, carbon black, calcium carbonate, talc and mixtures thereof.

10. The tufted surface covering of claim 2, wherein said tufting material is selected from the group consisting of: a polyamide, a polyester, a polypropylene, a natural fiber and mixtures thereof.

11. A tufted surface covering, comprising:

a first layer formed from particles of a polymer compound mixed with a quantity of a particle binding agent, said particle binding agent causing a portion of said particles to bind together;

said first layer having an upper surface and a lower surface;

said first layer being tufted through with a tufting material to form a plurality of spaced apart tufting material tufts on said first layer upper surface and a plurality of spaced apart tufting material loops on said first layer lower surface;

a second layer having an upper surface and a lower surface, said second layer including particles of a polymer mixed with a quantity of a particle binding agent; and said particle binding agent causes a portion of said first layer lower surface particles to join together with a portion of said second layer upper surface particles to seal said tufts and said loops in said first layer.

12. The tufted surface covering of claim 11 wherein:

said polymer compounds have thermosetting characteristics; and following tufting, said particles are joined together at a temperature of from about 100° C. to about 220° C. and a pressure of up to about 2 tons per square inch.

13. The tufted surface covering of claim 12, wherein:

each of said thermosetting polymer compounds is selected from the group consisting of: a vulcanized natural rubber, a synthetic rubber and mixtures thereof.

14. The tufted surface covering of claim 13, wherein:

each of said thermosetting polymer compounds is selected from the group consisting of: nitrile-butadiene rubber, styrene-butadiene rubber, ethylene propylene difunctional monomer copolymer, ethylene-vinyl acetate copolymer, polyvinyl chloride, polychloroprene, polyurethane and mixtures thereof.

15. The tufted surface covering of claim 12, wherein:

each of said particle binding agents comprises a cross-linking agent.

16. The tufted surface covering of claim 15, wherein:

each of said cross-linking agents is selected from the group consisting of: sulphur, zinc oxide, dibutyl thiourea, tellurium diethyldithiocarbonate, ethylene propylene difunctional monomer copolymer, ethylene-vinyl acetate copolymer, polypropylene and mixtures thereof.

17. The tufted surface covering of claim 12, wherein:

each of said particle binding agents comprises a polar polymer-containing compound.

18. The tufted surface covering of claim 17, wherein:

each of said polar polymer-containing compounds is selected from the group consisting of: polyurethane, ethylene propylene difunctional monomer copolymer, ethylene-vinyl acetate copolymer, a polyamide, polypropylene, latex and mixtures thereof.

19. The tufted surface covering of claim 12, wherein:

each of said first layer and said second layers further includes a compound selected from the group consisting of: a plasticizer, stearic acid, an ultraviolet radiation stabilizer, zinc oxide, carbon black and calcium carbonate, talc and mixtures thereof.

20. The tufted surface covering of claim 12, wherein said second layer includes a blowing agent.

21. The tufted surface covering of claim 12, wherein said second layer lower surface includes a plurality of spaced indentations for reducing a weight of the covering.

22. The tufted surface covering of claim 12, wherein said tufting material is selected from the group consisting of: a polyamide, a polyester, a polypropylene, a natural fiber and mixtures thereof.

23. The tufted surface covering of claim 12, wherein said first and second layers each include a plurality of spaced apart apertures for draining a fluid from said surface covering.

24. a method of making a tufted surface covering, comprising the steps of:

providing a base formed from particles of a thermosetting polymer compound mixed with a quantity of a particle binding agent, said particle binding agent causing a portion of said particles to bind together;

said base having an upper surface and a lower surface; and threading a needle with a tufting material and inserting the needle through said base at spaced intervals to form a series of tufting material tufts on said base upper surface and a series of tufting material loops on said base lower surface.

25. The method according to claim 24, said particle binding agent comprising a cross-linking agent, and including the step of:

subjecting said tufted base to a temperature of from about 100° C. to about 220° C. and a pressure of up to about 2 tons per square inch to join said particles together.

26. The method according to claim 24, including the steps of:

coating said base lower surface and loops with particles of a polymer compound mixed with a quantity of a binding agent to form a second layer; and permitting a portion of said base particles to join together with a portion of said second layer particles and seal said tufts and said loops in said first layer.

27. The method according to claim 26, each of said particle binding agents comprising a cross-linking agent and including the step of:

subjecting said tufted surface covering to a temperature of from about 100° C. to about 220° C. and a pressure of up to about two tons per square inch to cause a portion of said base particles to join together with a portion of said second layer particles.

28. The method according to claim 27, said second layer further including an upper surface and a lower surface, and including the step of:

heating said tufted surface covering from said second layer lower surface.

29. The method according to claim 28, including the step of:

while heating said tufted surface covering, at the same time cooling said tufts to protect the tufting material from the heat.

* * * * *